United States Patent [19]

Holland

[11] Patent Number: 4,836,623

[45] Date of Patent: Jun. 6, 1989

[54] EXECUTIVE DESK CONVERTIBLE INTO A COMPUTER CENTER

[76] Inventor: Robert C. Holland, 931 State Rd., 434 - Ste. 1201, Altamonte Springs, Fla. 32714

[21] Appl. No.: 174,871

[22] Filed: Mar. 29, 1988

[51] Int. Cl.[4] ..... A47B 17/00

[52] U.S. Cl. ..... 312/195; 312/312

[58] Field of Search ..... 512/194, 195, 196, 282, 512/312; 108/38, 39

[56] References Cited

U.S. PATENT DOCUMENTS

| | | | |
|---|---|---|---|
| 145,378 | 12/1873 | Wilkins | 312/312 |
| 1,167,046 | 1/1916 | Campbell | 108/38 X |
| 1,289,833 | 12/1918 | Lohr | 312/19 X |
| 1,485,549 | 3/1924 | Bieneman | 312/194 X |
| 1,948,303 | 2/1934 | Fanarjian | 312/196 |
| 2,019,455 | 10/1935 | Lehman | 312/312 |
| 3,245,241 | 4/1966 | Bartlett | 312/196 X |
| 4,515,086 | 5/1985 | Kwiecinski et al. | 312/196 X |

*Primary Examiner*—Joseph Falk

*Attorney, Agent, or Firm*—Leo J. Aubel

[57] ABSTRACT

An executive desk which is readily and conveniently convertible from an executive desk to a computer center. The desk includes a cabinet for receiving a computer and a display screen. The top of the cabinet comprises a part of the top or working surface of the desk when the cabinet is in a retracted or executive desk position. The cabinet is elevatable from the retracted position to a computer center position wherein the computer is operable and the display screen may be viewed by the operator. The back part of the desk includes a platform formed in a central well for receiving a computer keyboard. A cover for the platform and well is hingeably affixed to the top of the cabinet and forms a part of the work surface of the desk when the cabinet is in its executive desk or retracted position.

6 Claims, 2 Drawing Sheets

EXECUTIVE DESK CONVERTIBLE INTO A COMPUTER CENTER

BACKGROUND OF INVENTION

An executive's desk is generally the central and most important piece of furniture in that executive's office, and it is normally also the most used furniture in that office. Accordingly it is common, for an executive to have an attractive and useful desk appropriate to his position.

Computers have now emerged as a useful and important tool for executives to execute their management functions. It has been found that many executives need to use computers to obtain and/or generate data important to their business. Therefore, computers are now often found in executive's offices.

Generally, the executive must use the computer for data gathering, generating or manipulating functions, and then must resume his management functions and vice versa.

Commonly, the computer and its associated display screen and keyboard have been randomly placed either behind the executive's desk, such as on a credenza or table; or, the computer, display screen and keyboard have been deposited on the executives desk. Frequently electrical wires/and the wires conveying data extend over everything in a cluttered ungainly fashion.

More specifically, the inventor hereof found that placing a computer, screen and keyboard on a prior-art desk removed most of the useful work surface on the desk. Further, the desk became cluttered with wiring and thus was not suitable for conducting his management functions. On the other hand the inventor found that having a computer in his office was essential to the conduct of his business.

SUMMARY OF INVENTION

The present invention relates to an executive desk which is readily and conveniently converted into a computer center. The desk in its one mode is an executive desk and in its other mode is a clean, streamlined and efficient computer center having shelves, and storage spaces for the computer and peripheral equipment. Further work surfaces for the operator are also provided.

The desk includes an elevatable cabinet portion. The desk has a well across the front and a cabinet is mounted in the well and, as will be explained herein below, is adapted to be elevated to an operative position exposing a shelve for mounting a computer therein. The cabinet also includes shelves or compartments for mounting various peripheral equipment. Importantly, the cabinet may be lowered to a retracted position in which the cabinet top is flush with the top of the desk to provide a flat planar work surface. Further the desk is provided with suitable electrical channels and terminals for mounting all the wiring in a hidden and unobstrusive position.

Importantly, in order to be useful, the desk must be converted from an executive desk to a computer center or vise versa, quickly, efficiently and at the touch of a button. Further it is important that the desk be converted from one mode to the other mode smoothly so that any desk lamps and other desk paraphernalia need not be removed when changing from one mode to the other.

Desks having cabinets which can be raised to an elevated position or lowered to a position presenting a planar work surface are generally known in the patent art, as shown in U.S. Pat. No. 3,245,741. However, for one reason or another none of the prior art desks have achieved any degree of commercial success.

Further, word processing work stations which comprise a portion of a desk and which have a recessed well for accomodating a keyboard and a raised tiltable portion for supporting a word processor and console are known in the art as shown in U.S. Pat. No. 4,515,086.

BRIEF DESCRIPTION OF DRAWINGS

Novel features and advantages of the present invention in addition to those mentioned above will become apparent to those skilled in the art from a reading of the following detailed description in conjunction with the accompanying drawing wherein.

DESCRIPTION OF INVENTION

Figure 1:
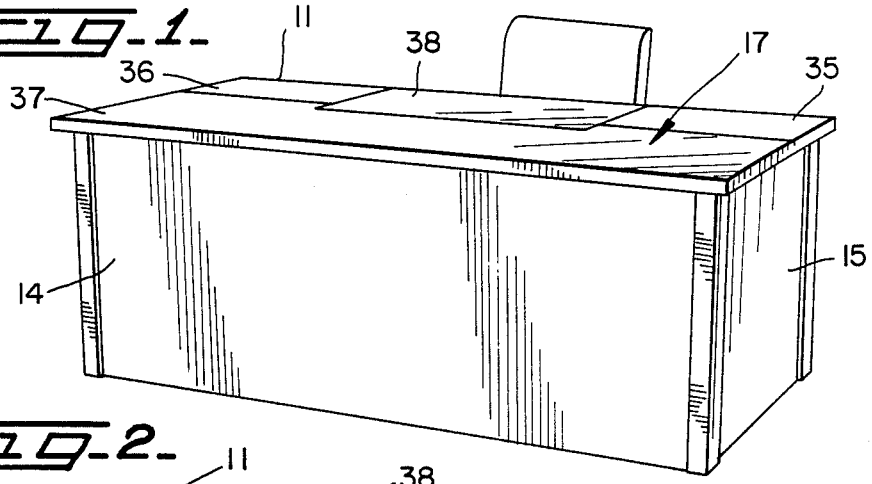
FIG. 1 is an isometric view of the front of the inventive desk in an executive desk or retracted position.

FIG. 1 shows a front view of the inventive desk 11. In one embodiment the desk 11 is eighty (80) inches in length, forty (40) inches in depth and thirty (30) inches in height. In the said embodiment, the desk is custom crafted from hardwood (solids and veneers) with a mahogony, cherry, walnut or oak finish in selected traditional or contemporary styling. Note that the desk 11 possess a clean uninterrupted upper surface or top 17 which functions as a conventional executive desk.

Figure 2:
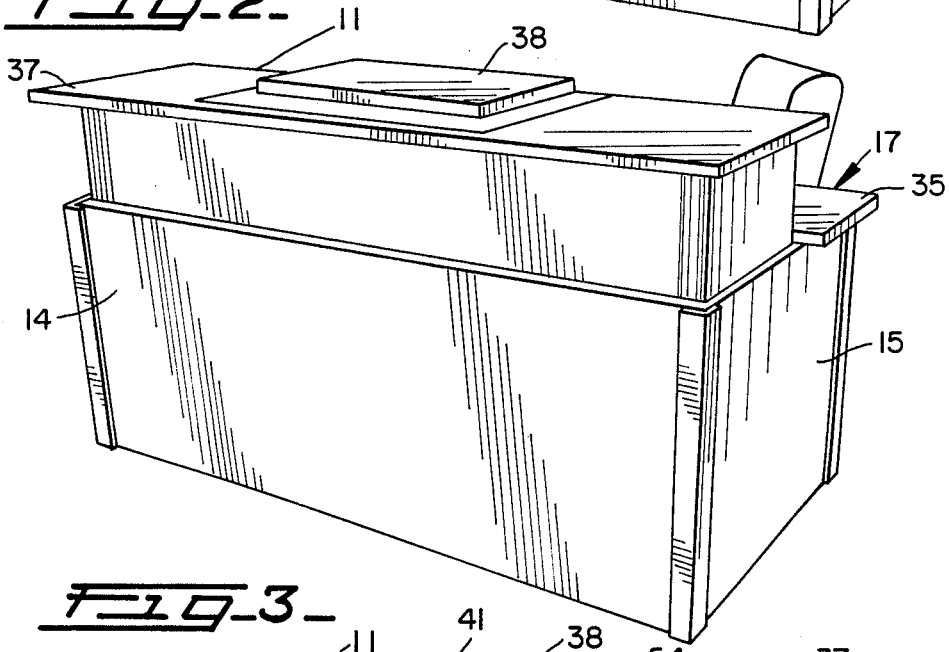
FIG. 2 is an isometric view of the front of the desk of FIG. 1 in an elevated position.

FIG. 2 shows the desk 11 in an elevated position. As will be explained in detail hereinafter, the desk 11 can be converted to this elevated position to serve as a computer center in about twenty (20) seconds. Note that the desk 11 retains its clean, uncluttered functional lines to still fit in, and enhance, the office decor when it is in its elevated position.

The upper surface 17 of desk 11 comprises multiple sectional surfaces, as will be explained hereinbelow. Surface 17 is structurally supported on a suitable frame as is well known. A front panel 14 and two side panels 15 and 16 which comprise essentially flat surfaces extend downwardly from the top 17.

Figure 3:
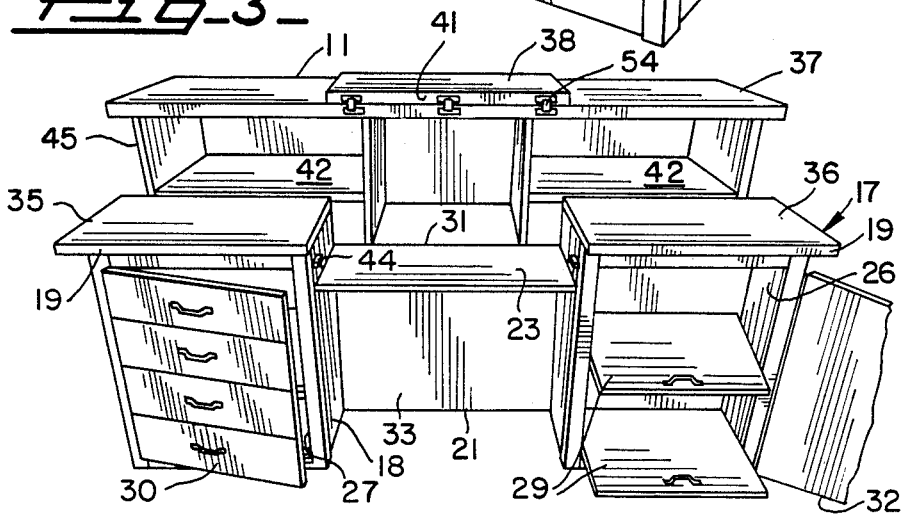
FIG. 3 is an isometric view of the back of the desk of FIG. 1 in an elevated position showing the cabinet shelving and storage.

As best seen in FIG. 3, the top 17 of desk 11 is provided with a knee opening 18. The opening 18 is preferably located centrally on the back edge of top 17. A platform 23 is positioned within opening 18, and as shown, platform 23 is recessed several inches from surface 17 to comfortably accomodate a keyboard (not shown) at an operable position for a seated operator.

Compartments 26 and 27 are mounted between side panels 15 and 16 on interior supports, as is well known. Slidable work shelves generally designated as 29 are located in the drawer compartments 26 and 27 for supporting peripheral equipment such as a laser printer, telefax unit, image scanner, etc. As mentioned the opening 18 and platform 23 thus define a knee well 21 between the drawer compartments 26 and 27. An inner divider wall 33 defines the depth of the knee well 21 and encloses the operating electrical motor and raising and lowering equipment, to be discussed.

The top 17 comprises sectional surfaces 35, 37, 38 and 39. As will be best seen in FIG. 3, top surface 37 extends along the front of the desk 11 from side 14 to side 15 (see also FIG. 5); and surface 37 comprises the top of a cabinet 45.

Top surface 35 forms a substantially rectangular section extending from the left corner and back 19 of the desk 11 to the opening 18 and forward to the edge of surface 37.

Top surface 36 forms a substantially rectangular section, similar to section 35, but extending from the right corner and back 19 of the desk 11 to the opening 18 and forward to the edge of surface 37.

As will become clear section 38 forms the central section of top 17 and covers opening 18. Section 38 is hinged at one edge 41 to the edge of surface 37 to be pivotable on surface 37.

Sections 35, 36, 37 and 38 are positioned to form the planar upper surface or top 17 and to fit edge to edge in a close abutting position to provide a smooth, essentially unbroken top 17, see FIG. 1.

A substantially rectangular well 43 (see FIG. 6) is formed adjacent the front panel 14 and extends between the two side panels 15 and 16. An elevatable cabinet 45 is positioned within well 43. Cabinet 45 moves upwardly and downwardly within the inner surface of front panel 14 and the two side panels 15 and 16.

As stated, the forward section 37 of top 17 forms or comprises the top of cabinet 45. Cabinet 45 includes a back panel 47 and two side panels 48 and 49 which move upwardly and downwardly within the well 43 formed by panels 14, 15 and 16 of desk 11. There is, of course, a slight clearance between the cabinet 45 and the panels 14, 15 and 16 and the supporting framework to prevent friction, scraping and marring of the outer surfaces of the cabinet 45 as it is moved vertically.

Cabinet 45 includes a central shelf compartment 31 such as for receiving a computer and display screen in a central position. Side shelf compartments 42 are arranged to receive peripheral equipment such as a modem, hard disk, radio, etc. Note that compartments 26 and 27 each have a respective single hinged door 30 and 32. Doors 30 and 32 are decorated to appear to be multiple drawers to provide an attractive appearance.

Importantly, and as stated above, the top section or cover 38 is hingeably mounted as by three concealed hinges 54 on the front surface 37 of the desk 11. When the cabinet 45 is to be moved to an elevated position the section or cover 38 is moved or folded back to lie flat, in an unobstrusive manner on the top 37 of cabinet 45, as shown in FIG. 2. When the cabinet 45 is lowered such that the desk 11 is in the executive mode the section or cover 38 is pulled or moved forward to cover the platform 23 and the keyboard on the platform. Suitable retaining shoulders 44 may be formed on the sides of the opening 18 to add support to the bottom edge of cover 38 when it is closed.

Figure 4:
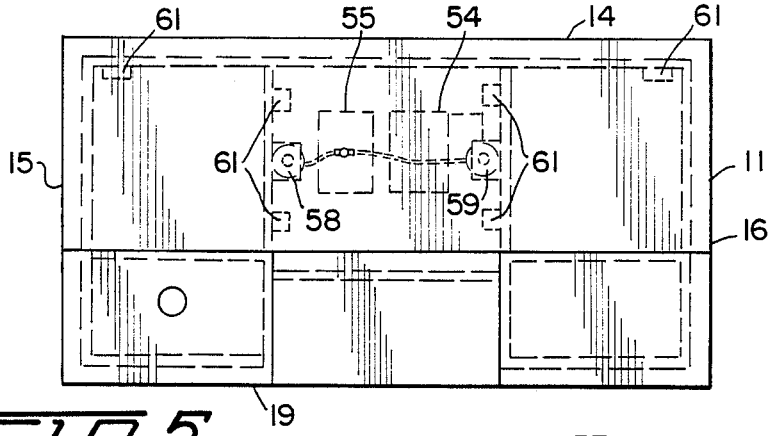
FIG. 4 is a sketch of a top view of the back of the desk of FIG. 1 in a retracted position.
Figure 5:
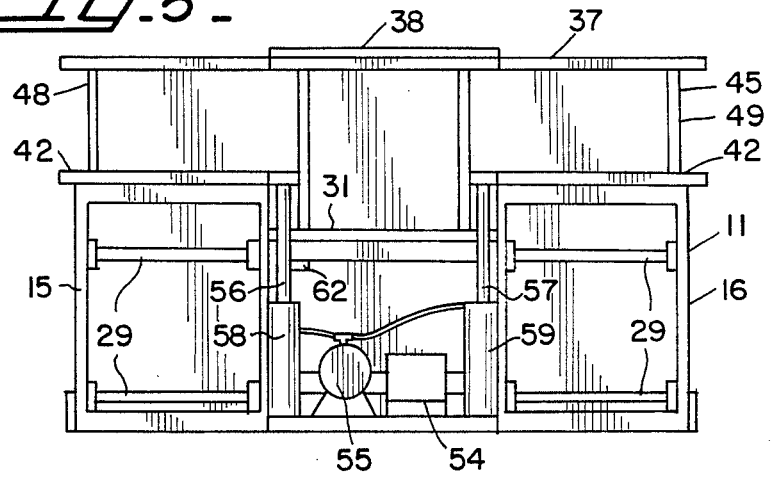
FIG. 5 is a sketch of a view of the back of the desk of FIG. 1 in a retracted position.

FIGS. 4 & 5 indicate a raising and lowering mechanism, which may be of any well known type used in the art, and comprises an electric motor 54 powering an air compressor 55 which in turn drives dual pistons 56 and 57 in respective cylinders 58 and 59. It is important that the cabinet 45 rise and lower smoothly and evenly. Accordingly, vertical guides generally indicated as 61 are positioned within the desk 11 to cause the cabinet 45 to rise and lower evenly. Suitable switch means 62 are mounted, such as underneath platform 23 to connect and disconnect power to drive the motor 54.

Figure 7:
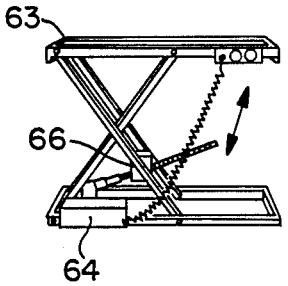
FIG. 7 is a view of one embodiment of a raising and lowering mechanism.

A second embodiment of the raising and lowering mechanism 63 is shown in FIG. 7. Mechanism 63 is a scissor type device which is actuated by an electric motor 64 through a known gear mechanism 66 to move up and down. Mechanism 63 may be centrally mounted beneath cabinet 45 to selectively rise and lower the cabinet. All the raising and lowering mechanism is hidden within the panels 14, 15 and 16 and wall 33. Further, all the electrical wiring and data cables are positioned within the aforesaid panels and divider wall. Only a telephone wire and a power cord extend externally of the desk 11. Thus a neat uncluttered appearance is achieved by eliminating or rather hiding all the unsightly and inconvenient wires, cables and cords.

Figure 6:
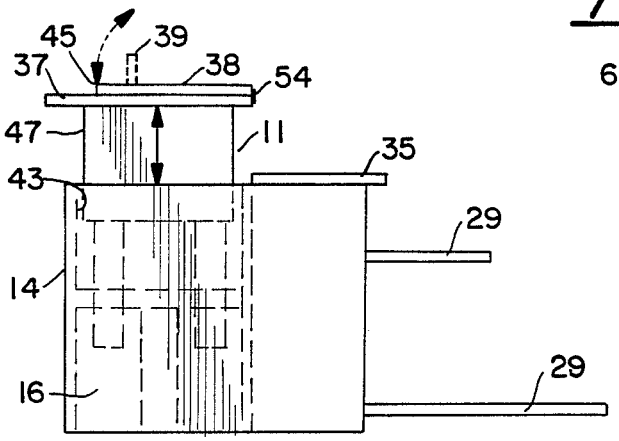
FIG. 6 is a side view of the desk of FIG. 1 indicating a raising and lowering operation.

As indicated in FIG. 6 cover 38 may include a lip 39 to extend downwardly adjacent the front of platform 23 to more fully enclose and protect the keyboard positioned on platform 23.

While the invention has been particularly shown and described with reference to a preferred embodiment thereof, it will be understood by those skilled in the art that various changes in form and details may be made therein without departing from the spirit and scope of the invention.

I claim:

1. An executive desk convertible into a computer center, accomodating at least a computer, a display screen and a keyboard, comprising (a) a substantially horizontal flat top, (b) front and two side panels extending vertically and positioned along edges of said top, (c) said top comprising a plurality of sectional edge mating surfaces, (d) said plurality of surfaces including a front surface having an edge positioned adjacent said front panel and extending between said side panels, a center surface, positioned to have an edge mating with the said front surface, a first side surface positioned adjacent a second edge of said center surface, and a second side surface positioned adjacent a third edge of said center surface, and said plurality of surfaces forming a substantially flat plane, (e) a rectangular well formed in said desk, said well extending along the front of said desk adjacent said front panel and between said side panels, (f) a cabinet mounted within said well, said front sectional surface of said top also forming the top of said cabinet, (g) said cabinet including shelves for supporting equipment such as a computer and a display screen, (h) means for selectively raising and lowering said cabinet relative to said said first and second side surfaces, (i) first and second groups of drawer compartments respectively mounted adjacent said first and second side panels, (j) a knee opening formed in said desk intermediate said drawer compartments, (k) said first and second side surfaces respectively positioned over said first and second groups of drawer compartments, (l) a platform positioned in said knee opening, said platform being at a lower position relative to said top, (m) said center surface comprising a cover for said platform, and, (n) hinge means, said cover center surface cover being mounted by said hinge means to said front surface, and being selectively pivotable to a first position to fold back on top of the center portion of said front surface, and to a second position to cover said platform.

2. A desk as in claim 1 wherein said cover is hingeably mounted on said front surface to fold flat thereon.

3. A desk as in claim 1 wherein said raising and lowering means is operable to selectively move said cabinet from an executive desk mode to the computer center mode within twenty seconds.

4. A desk as in claim 1 wherein said cover is hingeable on said cabinet top to be foldable over said cabinet top.

5. A desk as in claim 1 wherein said means for selectively raising and lowering said cabinet comprises motor means.

6. A desk as in claim 1, wherein said desk comprises four sectional edge mating surfaces, two of which surfaces are relatively stationary and one of which surfaces is vertically movable, and one of which surfaces is hingeably mounted on said moveable surface.

* * * * *